US011969047B2

(12) United States Patent
Meir et al.

(10) Patent No.: US 11,969,047 B2
(45) Date of Patent: Apr. 30, 2024

(54) KNITTED COMPONENT WITH INSERTED ELEMENTS

(71) Applicant: NIKE, Inc., Beaverton, OR (US)

(72) Inventors: Adrian Meir, Portland, OR (US); James Molyneux, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 16/899,924

(22) Filed: Jun. 12, 2020

(65) Prior Publication Data

US 2020/0397090 A1 Dec. 24, 2020

Related U.S. Application Data

(60) Provisional application No. 62/863,660, filed on Jun. 19, 2019.

(51) Int. Cl.

| | |
|---|---|
| ***A43B 1/04*** | (2022.01) |
| ***A43B 23/02*** | (2006.01) |
| ***A43C 11/00*** | (2006.01) |
| ***A43C 11/16*** | (2006.01) |

(52) U.S. Cl.

CPC ..... *A43B 1/04* (2013.01); *A43B 23/024* (2013.01); *A43C 11/008* (2013.01); *A43C 11/165* (2013.01); *A43B 23/0245* (2013.01); *D10B 2501/043* (2013.01)

(58) Field of Classification Search

CPC ..... A43B 1/04; A43C 11/008; A43C 11/165

See application file for complete search history.

(56) References Cited

U.S. PATENT DOCUMENTS

| | | | | |
|---|---|---|---|---|
| 5,117,567 | A * | 6/1992 | Berger | A43B 1/0072 36/50.1 |
| 5,566,474 | A * | 10/1996 | Leick | A43C 1/06 24/713.9 |
| 5,615,562 | A | 4/1997 | Roell | |
| 6,032,387 | A * | 3/2000 | Johnson | A43C 1/06 36/118.1 |
| 6,117,332 | A | 9/2000 | Hatch et al. | |

(Continued)

FOREIGN PATENT DOCUMENTS

| | | | |
|---|---|---|---|
| CN | 105209676 | A | 12/2015 |
| WO | 2014/085205 | A1 | 6/2014 |

OTHER PUBLICATIONS

Office Action in corresponding PCT Application No. PCT/US2020/037530 dated Sep. 7, 2020 (12 pages).

(Continued)

*Primary Examiner* — Megan E Lynch

(74) *Attorney, Agent, or Firm* — Shook, Hardy & Bacon L.L.P.

(57) ABSTRACT

An article of footwear may include a knitted component that at least partially forms an upper. The knitted component may include a first knit layer and a second knit layer, the first knit layer being separable from the second knit layer such that a pocket is located between the first knit layer and the second knit layer. A cable may be located at least partially within the channel. A cable guide may additionally be located at least partially within the channel, where the cable guide includes at least one curved surface for contacting the cable. The cable may extend around the at least one curved surface such that the cable changes directions within the channel.

20 Claims, 7 Drawing Sheets

(56) References Cited

U.S. PATENT DOCUMENTS 6,922,917 B2 * 8/2005 Kerns ..... A43B 5/14 36/50.1
7,222,504 B2 5/2007 Nakayama
7,281,341 B2 * 10/2007 Reagan ..... A43B 3/0031 36/50.1
8,522,577 B2 9/2013 Huffa
8,881,430 B2 * 11/2014 Seamarks ..... A43B 23/0235 36/45
8,959,959 B1 2/2015 Podhajny
9,060,570 B2 6/2015 Huffa et al.
9,700,101 B2 * 7/2017 Lovett ..... A43C 3/02
2004/0181972 A1 9/2004 Csorba
2005/0126043 A1 6/2005 Reagan et al.
2007/0011914 A1 1/2007 Keen et al.
2010/0154256 A1 * 6/2010 Dua ..... A43B 23/0205 36/25 R
2010/0175278 A1 7/2010 Seliger
2011/0030244 A1 2/2011 Motawi et al.
2011/0047821 A1 3/2011 Rosen
2012/0000091 A1 * 1/2012 Cotterman ..... A43C 11/008 36/50.1
2013/0145652 A1 6/2013 Podhajny et al.
2014/0310983 A1 10/2014 Tamm et al.
2015/0013188 A1 * 1/2015 Seamarks ..... A43B 5/06 36/84
2015/0059206 A1 3/2015 Lovett et al.
2015/0296922 A1 10/2015 Rushbrook et al.
2016/0058100 A1 * 3/2016 Dealey ..... D04B 1/22 36/84
2016/0088893 A1 * 3/2016 Meir ..... A43B 23/027 66/190
2016/0088899 A1 3/2016 Liles et al.
2016/0331083 A1 * 11/2016 Uesato ..... A43B 23/0265
2017/0079366 A1 3/2017 Cross et al.
2017/0105489 A1 4/2017 Lovett
2017/0265560 A1 * 9/2017 Beers ..... A43C 11/008
2017/0265561 A1 * 9/2017 Beers ..... A43B 3/0005
2017/0265573 A1 * 9/2017 Beers ..... A43B 3/34
2018/0110296 A1 4/2018 Dombrow et al.
2018/0110298 A1 * 4/2018 Schneider ..... A43C 1/00
2018/0153263 A1 * 6/2018 Beers ..... A43B 3/0005
2018/0168272 A1 6/2018 Droege et al.
2018/0199673 A1 * 7/2018 Schneider ..... A43B 23/0245
2019/0037966 A1 * 2/2019 Aceves Tinajero .. D04B 21/207
2019/0098963 A1 * 4/2019 Beers ..... A43C 11/008
2019/0116935 A1 * 4/2019 Avar ..... A43B 23/0265
2019/0246745 A1 * 8/2019 Bock ..... A43B 3/36
2019/0313742 A1 * 10/2019 Bell ..... A43C 1/00
2020/0375316 A1 12/2020 Dealey et al.

OTHER PUBLICATIONS

International Preliminary Report on Patentability received for PCT Patent Application No. PCT/US2020/037530, dated Dec. 30, 2021, 11 pages.
International Search Report and Written Opinion for PCT application No. PCT/US2020/037530, dated Nov. 19, 2020, 16 pages.

* cited by examiner

KNITTED COMPONENT WITH INSERTED ELEMENTS

RELATED APPLICATIONS

This application claims the benefit of U.S. Provisional Application No. 62/863,660, filed Jun. 19, 2019, which is hereby incorporated by reference in its entirety.

BACKGROUND

Conventional articles of footwear generally include two primary elements: an upper and a sole structure. The upper is generally secured to the sole structure and may form a void within the article of footwear for comfortably and securely receiving a foot. The sole structure is generally secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole may be secured to a lower surface of the midsole and may form a ground-engaging portion of the sole structure that is formed from a durable and wear-resistant material.

The upper of the article of footwear generally extends over the instep and toe areas of the foot, along the medial and lateral sides of the foot, and around the heel area of the foot and in some instances under the foot. Access to the void in the interior of the upper is generally provided by an ankle opening in and/or adjacent to a heel region of the footwear. A lacing system is often incorporated into the upper to adjust the fit of the upper, thereby facilitating entry and removal of the foot from the void within the upper. In addition, the upper may include a tongue that extends under the lacing system to enhance adjustability of the footwear, and the upper may incorporate other structures such as, for example, a heel counter to provide support and limit movement of the heel.

BRIEF DESCRIPTION OF THE DRAWINGS

The embodiments of the present disclosure may be better understood with reference to the following drawings and description. The components in the figures are not necessarily to scale, with emphasis instead being placed upon illustrating the principles of the present disclosure. Moreover, in the figures, like referenced numerals designate similar or identical features.

DETAILED DESCRIPTION

Figure 1:
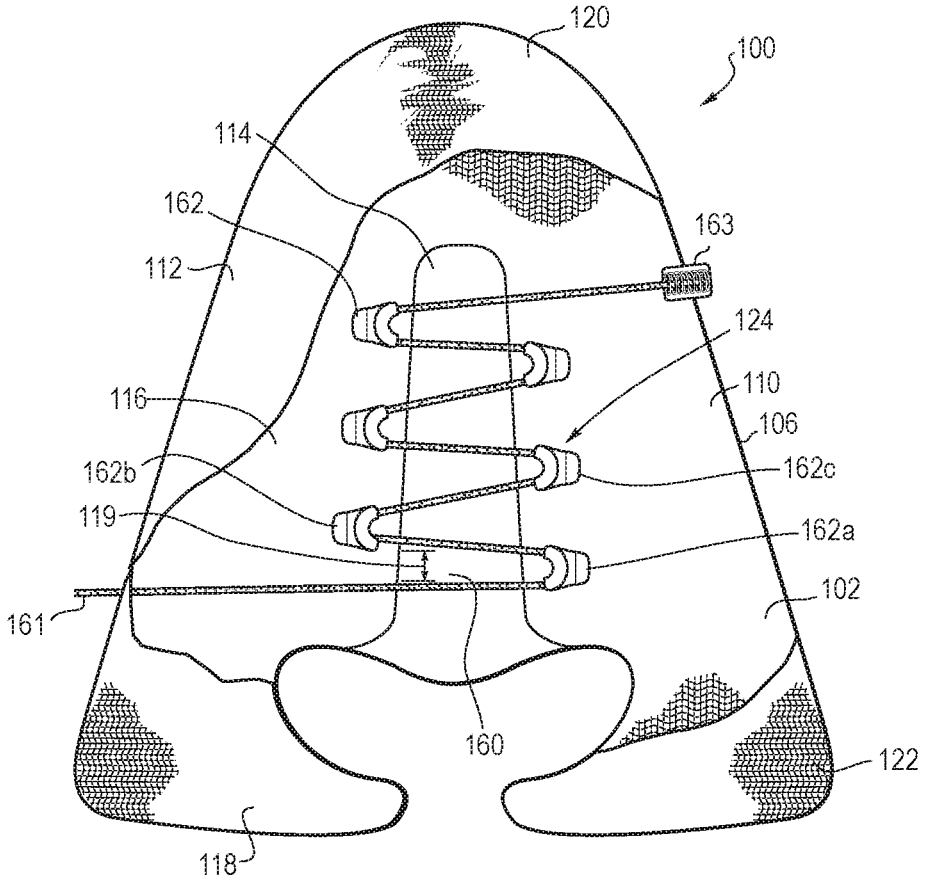
FIG. 1 is an illustration showing a knitted component forming an upper for an article of footwear having an inserted tensioning system in accordance with certain aspects of the present disclosure.

Various aspects are described below with reference to the drawings in which like elements generally are identified by like numerals. The relationship and functioning of the various elements of the aspects may better be understood by reference to the following detailed description. However, aspects are not limited to those illustrated in the drawings or explicitly described below. It also should be understood that the drawings are not necessarily to scale, and in certain instances details may have been omitted that are not necessary for an understanding of aspects disclosed herein, such as conventional fabrication and assembly.

Certain aspects of the present disclosure relate to uppers configured for use in an article of footwear and/or other articles, such as articles of apparel. When referring to articles of footwear, the disclosure may describe basketball shoes, running shoes, biking shoes, cross-training shoes, football shoes, golf shoes, hiking shoes and boots, ski and snowboarding boots, soccer shoes, tennis shoes, and/or walking shoes, as well as footwear styles generally considered non-athletic, including but not limited to dress shoes, loafers, and sandals.

FIG. 1 is an illustration showing an example of an upper 102 for an article of footwear. In the article of footwear, the upper 102 may be secured to a sole structure (not shown). The area where the sole structure joins the upper 102 may be referred to as a biteline 106 (which is not necessarily exactly at the perimeter edge of the upper 102). The upper 102 may be at least partially formed by a knitted component 122, and be joined to the sole structure in a fixed manner using any suitable technique, such as through the use of an adhesive, by sewing, etc. The sole structure may define the bottom surface of a void for receiving and accommodating a user's foot, and the upper 102 may define the sides of the void.

Referring to FIG. 1, which shows the knitted component 122 as it may appear after knitting but prior to being manipulated into a wearable shape to form the upper 102, the upper 102 may include a lateral side 110 and a medial side 112. A throat area 114 may be included between the lateral side 110 and the medial side 112, and the throat area 114 may be positioned to cover the top (dorsal) surface of the foot during typical use. A midfoot area 116 of the upper 102 may be located between a heel area 118 and a toe area 120. The throat area 114 may be primarily located in the midfoot area 116. In some embodiments, an optional tongue may be disposed at least partially in the throat area 114.

At least a portion of the upper 102 may be formed with a knitted component 122 (or another suitable textile component). For example, the upper 102 may be formed primarily as an integral one-piece element during a knitting process, such as a weft knitting process (e.g., with a flat knitting machine or circular knitting machine), a warp knitting process, or any other suitable knitting process. That is, the knitting process on the knitting machine may substantially form the knit structure of the knitted components without the need for significant post-knitting processes or steps. Alternatively, the knitted component 122 may be formed separately as distinct integral one-piece elements and then the respective elements attached (e.g., via sewing).

Forming the upper with a knitted component 122 may impart advantageous characteristics including, but not limited to, a particular degree of elasticity (for example, as expressed in terms of Young's modulus), breathability, bendability, strength, moisture absorption, weight, abrasion resistance, and/or a combination thereof. These characteristics may be accomplished by selecting a particular single layer or multi-layer knit structure (e.g., a ribbed knit structure, a single jersey knit structure, or a double jersey knit structure), by varying the size and tension of the knit structure, by using one or more yarns formed of a particular material (e.g., a polyester material, a relatively inelastic material, or a relatively elastic material such as spandex), by selecting yarns of a particular size (e.g., denier), and/or a combination thereof. The weight of the upper 102, and thus the overall weight of the article of footwear, may be reduced with respect to alternative uppers and/or other components that are typically used in footwear. The knitted component 122 may also provide desirable aesthetic characteristics by incorporating yarns having different colors, textures or other visual properties arranged in a particular pattern. The yarns themselves and/or the knit structure formed by one or more of the yarns of the knitted components may be varied at different locations to provide different knit portions with different properties (e.g., a portion forming the throat area 114 of the knitted component 122 may be relatively elastic while a portion forming the heel area 118 or another area may be relatively inelastic).

In some embodiments, the knitted component 122 may incorporate one or more materials with properties that change in response to a stimulus (e.g., temperature, moisture, electrical current, magnetic field, or light). For example, as described in more detail below, the knitted component 122 may include yarns formed of a thermoplastic polymer material (e.g., a polyurethane, polyamide, polyolefin, and/or nylon) that transitions from a solid state to a softened or liquid state when subjected to certain temperatures at or above its melting point and then transitions back to the solid state when cooled. The thermoplastic polymer material may provide the ability to heat and then cool a portion of the knitted component 122 to thereby form an area of bonded or continuous material (herein referred to as a "fused area") that exhibits certain advantageous properties including a relatively high degree of rigidity, strength, and water resistance, for example.

As shown in FIG. 1, the article of footwear may include a tensioning system 124 that affects the geometry of the upper 102 such that the upper 102 properly fits the foot of a user and remains on the user's foot during normal use. In typical articles of footwear, a shoelace is used. One example of a tensioning system is described in U.S. Provisional Patent Application No. 62/855,556, filed May 31, 2019, which is hereby incorporated by reference in its entirety. In the depicted embodiment of FIG. 1, instead of a shoelace (though a shoelace may additionally be included in contemplated embodiments), the present embodiment includes at least one cable 160 extending over the foot of a wearer (when the article of footwear is in use). Notably, a similar or identical tensioning system may be used in other articles, such as articles of apparel (e.g., to tighten an article of apparel around a particular body part of a human, for example). Without limitation, a similar or identical tensioning system may be used to form an adjustable fit, support, etc. for bras, tights, leggings, jackets, midlayers, baselayers, hoodies, or any other suitable article of apparel (or other article). Thus, the concepts described herein as they related to an article of footwear are also applicable to knitted articles outside a technical field limited to only footwear.

Referring to the upper 102 for the article of footwear in FIG. 1, the cable 160 may extend across the throat area 114 of the upper 102. For example, the cable 160 may extend from the lateral side 110 of the upper 102, over the throat area 114 and to the medial side 112, and then back (e.g., in a serpentine pattern). An exposed end 161 of the cable 160 may be accessible such that the tension of the cable 160 can be manipulated, thereby providing the ability to adjust the fit of the upper 102 around a user's foot. Additionally or alternatively, one or more actuators (see actuator 163) (which may also be referred to as an "adjustment system") may be included for adjusting the cable 160, in particular by tensioning the cable and/or by moving the cable 160 relative to the curved surfaces of the cable guides 162. The actuator 163 may be inserted into the knitted component (as described in more detail below), or not. In some embodiments, the actuator 163 may include an electric motor or other automatically-actuatable device that provides tension to the cable 160 without an input force being supplied by a user (e.g., upon user initiation, through pressing a button or otherwise interfacing with the actuator 163). Alternatively, the actuator 163 may transfer a user-inputted force to the cable 160 (e.g., a user may pull on a lever or otherwise provide an input force that spins a spool). Without limitation, the actuator 163 may include one or more of a motor, clamp or other device for fixing selectively fixing/releasing a portion of the cable 160, spool, etc. Any other suitable actuator, whether user-powered or utilizing a different energy source, may be included.

A set of cable guides 162 (which are described in more detail below), which may be inserted within the knitted component 122 (e.g., during knitting on a knitting machine, such that the cable guides 162 are a portion of the knitted component 122) may be located where the cable 160 changes directions, for example. In some embodiments, for example, at least the throat area 114 of the adjacent knitted loops of the knitted component 122 may be relatively elastic such that it conforms to the shape of the foot, while the cable 160 may be relatively inelastic such that it retains the article of footwear on the user's foot, and in an appropriate position relative to the user's foot, during normal use. As shown in FIG. 1, the cable 160 extends in a serpentine pattern that crosses the throat area 114 on seven (7) occasions, though more or less crosses of the throat area 114 may be included.

Figure 2:
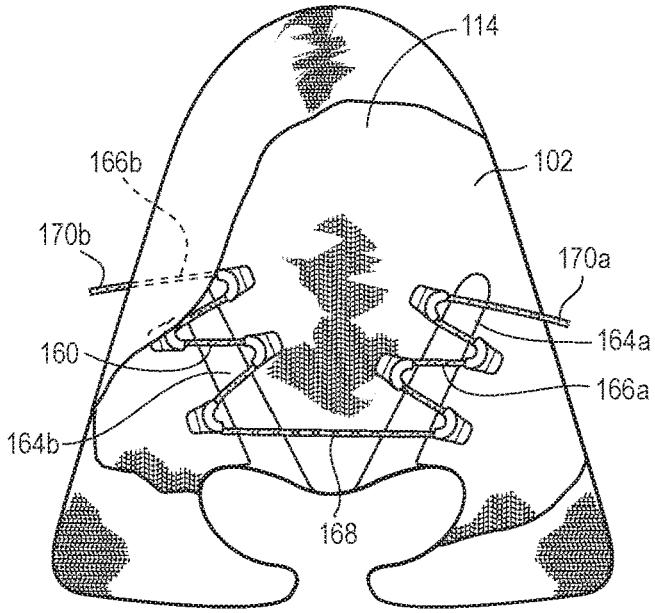
FIG. 2 is an illustration showing another embodiment of a knitted component forming an upper for an article of footwear having an inserted tensioning system in accordance with certain aspects of the present disclosure.
Figure 3:
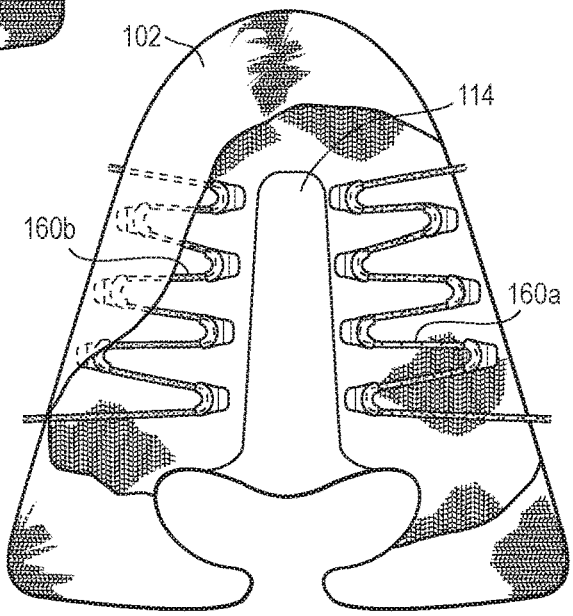
FIG. 3 is an illustration showing another embodiment of a knitted component forming an upper for an article of footwear having an inserted tensioning system in accordance with certain aspects of the present disclosure.
Figure 4:
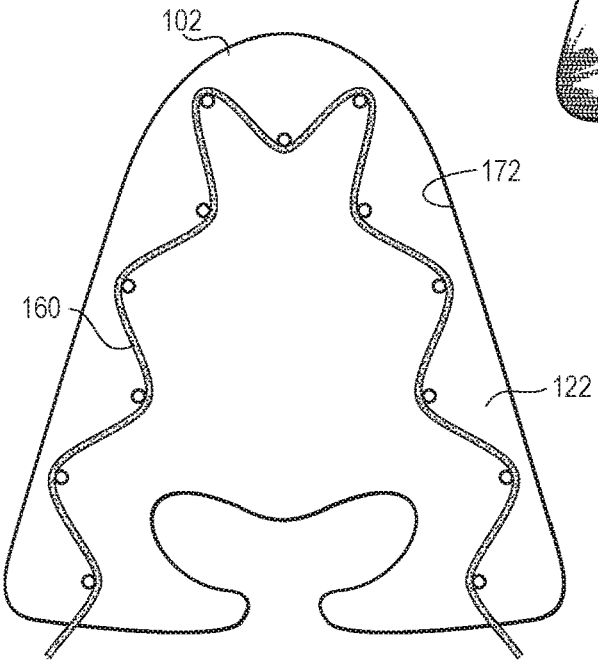
FIG. 4 is an illustration showing another embodiment of a knitted component forming an upper for an article of footwear having an inserted tensioning system in accordance with certain aspects of the present disclosure.

Other embodiments are also contemplated. FIG. 2, for example, shows two elastic areas 164*a*, 164*b* that are generally located on the lateral and medial sides of the throat area 114, respectively. The cable 160 includes two serpentine patterns 166*a*, 166*b* and a central portion 168 that connects one serpentine pattern to the other. Exposed ends 170*a*, 170*b* of the cable 160 may be manipulated to tighten (or loosen) the article of footwear around a user's foot. Advantageously, the cable 160 of this embodiment, and the associated cable guides (described in more detail below), are generally spaced from the throat area 114, which may prevent "hot spots," or spots where a concentrated force causes foot discomfort, from the top of the foot (which is a common area for user discomfort). Similarly, FIG. 3 depicts an embodiment with two separate cables 160*a*, 160*b*, which may pull the upper 102 into a tensioned state (e.g., to retain a foot within the respective void) without extending a cable over the throat area 114. FIG. 4 includes a single cable 160 that extends around cable guides placed near the perimeter edge 172 of the knitted component 122, for example. Each of the embodiments shown in FIGS. 1-4 are included as examples only, and any suitable cable orientation (or combination thereof) may be included.

Figure 5A:
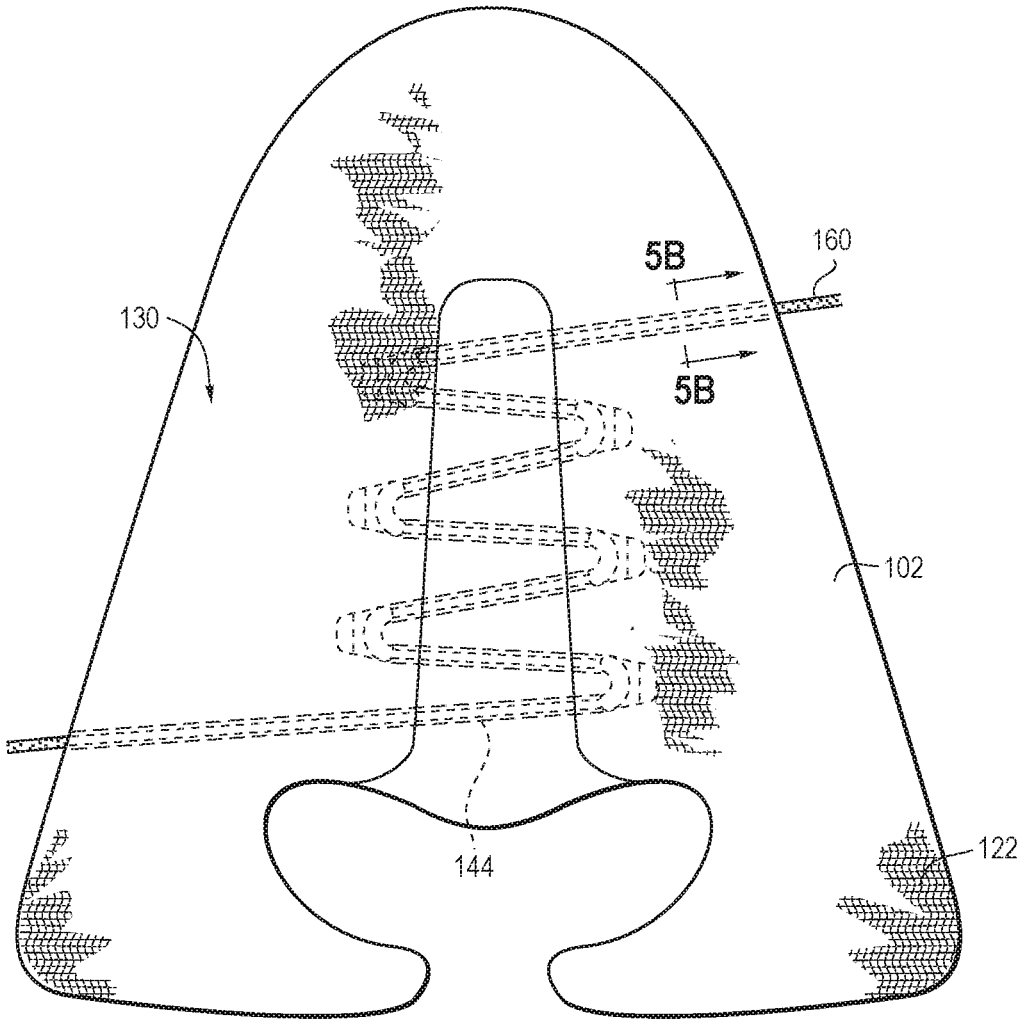
FIG. 5A is an illustration showing another embodiment of a knitted component forming an upper for an article of footwear having an inserted tensioning system in accordance with certain aspects of the present disclosure.
Figure 5B:
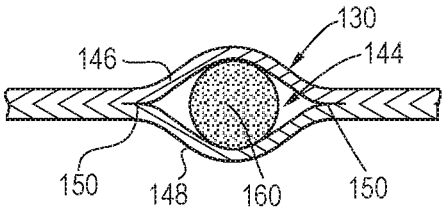
FIG. 5B is an illustration showing a section view about section 5B-5B depicted in FIG. 5A.

Referring to FIGS. 5A-5B, at least a portion of the cable 160 may be inlaid between certain loops of the knitted component 122 on a knitting machine during the manufacturing of the knitted component 122. The cable 160 may be inserted within the tube 144 during a knitting process, such as by utilizing an inlay process. For example, an inlay process may include using an inlay feeder or other mechanical inlay device on a knitting machine (e.g., a combination feeder) to place the cable 160 between two needle beds (e.g., front and back needle beds) during a knitting process. One example of an inlay process, along with a combination feeder for enabling such a process, is described in U.S. Patent Application Publication No. 2013/0145652, published Jun. 13, 2013, and having an applicant of NIKE, Inc., which is hereby incorporated by reference in its entirety. For example, as described in U.S. Patent Application Publication No. 2013/0145652, the knitted component 122 may have horizontal courses and vertical wales defined by a plurality of intermeshed loops, where the inlaid element (the cable 160) may extend along one of the courses and alternate between being located behind intermeshed loops and in front of the intermeshed loops. Alternatively, the cable 160 may be fed through the tubes 144 of the knitted component 122 by hand. It is contemplated that the cable 160 may be attached to the remainder of the upper 102 in a different way (e.g., other than being located in a tube), such as by using an adhesive to secure the cable 160 directly to the exterior surface 130 of the upper 102.

FIG. 5B shows a view of a single knit tube 144 of the upper 102 with the cable 160 located therein. The tube 144, as shown, is generally a hollow structure formed by two overlapping and at least partially coextensive layers of knitted material. Although the sides or edges of one layer of the knitted material forming the tube 144 may be secured to the other layer (e.g., if a two-layer construction extends beyond the tube 144), a central area is generally unsecured such that another element (e.g., the cable 160) may be located between the two layers of knitted material and pass through the tube 144.

More specifically, the tube 144 may be formed by a multi-layer knit structure, such as a tubular knit structure. The tubular knit structure may be formed by a tubular knitting process where a first knit layer formed on a first bed of the knitting machine remains separable from (e.g., having a central area not locked to) a second knit layer formed on a second needle bed for a plurality of courses. For example, a first layer 146 of the tube 144, which may define the exterior surface 130 of the knitted component 122, may be formed on a first needle bed of a knitting machine (e.g., with a single-jersey or similar knit structure). A second layer 148 of the tube 144, which may define an inner surface of the knitted component 122, may be formed on a second needle bed of the knitting machine (e.g., with a single-jersey or similar knit structure). The edges 150 of the tube 144 (which extend along the tube's length) may be locations where a course at the end of the tubular knit structure (in the knitting direction) utilizes both needle beds, thus locking the first layer 146 and the second layer 148 together (though discrete layers may optionally continue, in a secured manner, past the edges 150 in some embodiments). In the resulting knitted component 122, a channel/tunnel may be formed between the first layer 146 and the second layer 148 of the tube 144, and that same channel may be used for receipt of the cable 160.

Notably, the first layer 146 and the second layer 148 may each comprise a plurality of single-jersey knit courses such that the tube 144 is large enough to receive the cable 160. For example, each of the first layer 146 and the second layer 148 may include at least 3 consecutive courses, such as at least 5 consecutive courses. More courses (e.g., 10 consecutive courses or more) may be used when a larger cable is utilized. While the first layer 146 and the second layer 148 may have the same number of courses (e.g., such that they have the same size, as shown), they may alternatively include a different number of courses and/or otherwise be differently sized (which may cause the cable 160 to have an offset orientation relative to a plane centralized between the opposite faces of the knitted component).

Figure 6A:
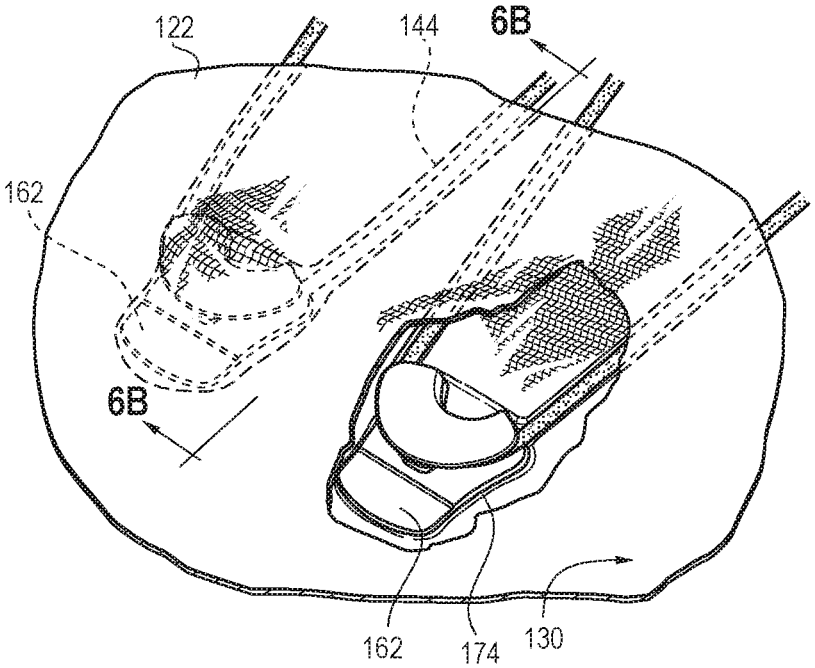
FIG. 6A is an illustration showing a selected portion of a knitted component forming an upper for an article of footwear having an inserted tensioning system, including two cable guides, in accordance with certain aspects of the present disclosure.
Figure 6B:
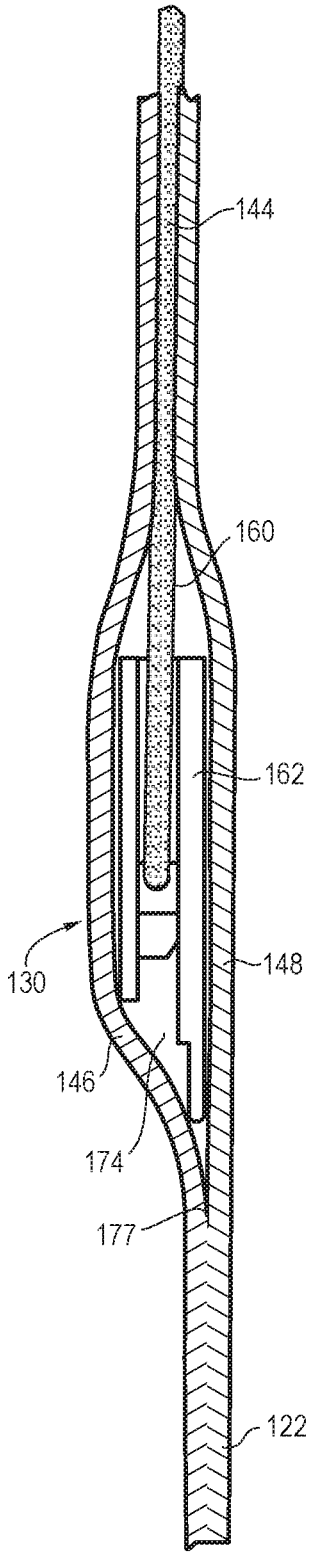
FIG. 6B is an illustration showing a section view about section 6B-6B depicted in FIG. 6A.

Similarly, referring to FIGS. 6A-6B, a cable guide 162 may be located between the first layer 146 and the second layer 148 within a pocket 174 (which may be continuous with, and/or the same element as, the tube 144 discussed above). When the pocket 174 is continuous with the tube 144 (i.e., such that they are formed of a continuous opening), they are, in some instances in this specification, collectively referred to as a single "pocket" (i.e., encompassing both the pocket 174 and the tube 144) located between respective layers. Thus, when incorporated into the article of footwear, the cable guide 162 may be at least partially (e.g., wholly) blocked from view from an external perspective. Like the tube described above, the pocket 174 may be formed by a multi-layer knit structure, such as a tubular knit structure. The tubular knit structure may be formed by a tubular knitting process where a first knit layer formed on a first bed of the knitting machine remains separable from (e.g., having a central area not locked to) a second knit layer formed on a second needle bed for a plurality of courses. For example, the first layer 146 of the pocket 174, which may define the exterior surface 130 of the knitted component 122, may be formed on a first needle bed of a knitting machine (e.g., with a single-jersey or similar knit structure). The second layer 148 of the pocket 174, which may define an inner surface of the knitted component 122, may be formed on a second needle bed of the knitting machine (e.g., with a single-jersey or similar knit structure). An edge 177 of the pocket 174 may include a course at the end of the tubular knit structure (in the knitting direction) that utilizes both needle beds, thus locking the first layer 146 and the second layer 148 together (though discrete layers may optionally continue, in a secured manner, past the edge 177 in some embodiments).

After knitting the knitted component 122, the pocket 174 may be generally inaccessible (at least during normal footwear assembly and use), and thus it may be advantageous to insert the cable guide 162 in the pocket 174 during the knitting process. For example, in some methods of manufacture, the cable guide 162 may be placed between the first layer 146 and the second layer 148 while loops of the first layer 146 are located on needles of a first needle bed and while loops of the second layer 148 are located on needles of a second needle bed (e.g., prior to forming at least one course that connects the first layer 146 and the second layer 148, such as at the edge 177). Advantageously, such an embodiment provides a complete (or nearly complete) tensioning system without necessitating cutting, stretching, or otherwise manipulating the knitted loops of the knitted component 122 after knitting to place the cable guides 162 in their operational locations, which may increase manufacturing efficiency and footwear durability. Further, in some embodiments, the interior of the pocket 174 may be about the same volume of the cable guide 162 (and it is contemplated that the first layer 146 and/or the second layer 148 may be in a stretched state, due to the size of the cable guide 162, relative to a theoretical default state if the cable guide 162 was not included). This may be advantageous for ensuring the cable guide 162 is precisely located in a desired position, and such that the movement of the cable guide 162 during footwear use is limited.

This feature may be made possible (or at least simplified) by including the cable guide 162 as a portion of the knitted component (that is, by inserting it with the knitting machine during a knitting process), as it may be impractical (e.g., extremely difficult and/or impossible) to insert the cable guide 162 into a relatively small pocket after knitting is complete. In some embodiments, the securement of the cable guide 162 may be enhanced (or fully formed) by another feature, such as by using an adhesive to secure the cable guide 162 within a particular location of the pocket 174. In certain embodiments, at least one of the cable guide 162 and the yarns of the knitted component (e.g., yarns within at least one of the first layer 146 and/or the second layer 148) may include a thermoplastic material (e.g., a thermoplastic polyurethane with a melting point of about 180 degree Celsius or less) such that, when heated during a heat-processing step (e.g., during or after knitting), the thermoplastic material at least partially fuses to surrounding material, thereby securing the cable guide 162 in place.

As shown in FIG. 6B, the pocket 174 may optionally have a thickness that is greater than a thickness of the tube 144 (e.g., since the cable guide 162 may be thicker than the cable 160). The relative thickness may be formed by any suitable structure and/or method. For example, in some embodiments, the number of courses utilized during tubular knitting to form the first layer 146 and second layer 148 may be greater when forming the pocket 174 than when forming the tube 144. Additionally or alternatively, the degree of stretch (relative to a non-stretched default state) of the first layer 146 and/or the second layer 148 may be higher in the pocket 174 than in the tube 144 when the knitted component 122 is fully formed.

Figure 7A:
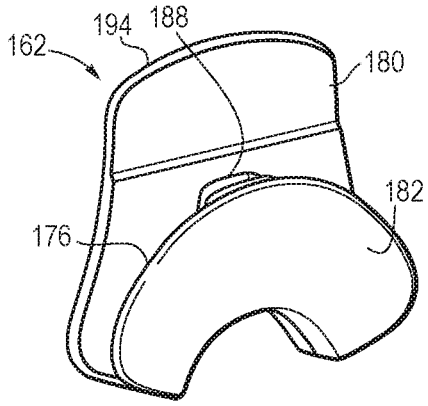
FIGS. 7A-C are illustrations showing various views of an embodiment of a cable guide for use in a knitted component in accordance with certain aspects of the present disclosure.
Figure 7B:
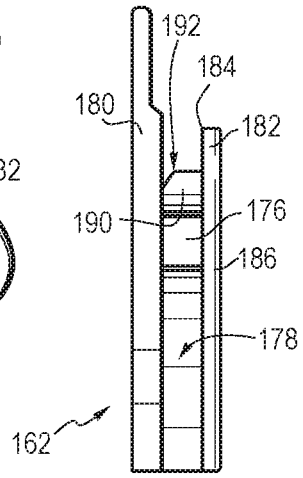
Figure 7C:
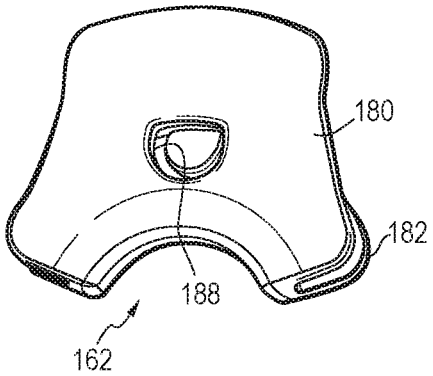

FIGS. 7A-7C show three views of an example of a cable guide 162. The cable guide 162 may include a groove 176 having a curved surface 178 for contact with the above-described cable, where the cable will extend at least partially around the curved surface 178 when the upper is assembled. Advantageously, the curve of the curved surface 178 may reduce friction between the cable and the cable guide 162 relative to non-curved surfaces. The curve of the curved surface 178 may have a radius and/or other dimension that is selected or optimized to provide a particular degree of friction, for example. Further, it is contemplated that the curved surface 178 may be intentionally smooth, and/or lubricated, to further enhance its friction-related properties.

The groove 176 may be formed between a back panel 180 and a front panel 182, and may be advantageous for retaining the cable in a desired location (e.g., in contact with the curved surface 178). At least one of the back panel 180 and the front panel 182 may include a flexible extension 184, which may form a deformable clip 186. As shown, the back panel 180 may include an opening 188 for receiving a head 190 of the deformable clip 186. The head 190 may include a sloped surface 192 such that, when a cable is placed over the head 190 and forced towards the curved surface 178, the head 190 of the deformable clip 186 is displaced (by the cable) such that the cable moves past the head 190 and into the groove 176. Then, due to the resilience of the material forming the deformable clip 186, for example, the head 190 of the deformable clip 186 may move back into its default position (shown in FIGS. 7A-7C), thereby retaining the cable within the groove 176.

Optionally, the cable guide 162 may include a locating tab 194 that extends from at least one of the back panel 180 and the front panel 182 (in this case, the back panel 180), which may be used to ensure that the cable guide 162 is properly oriented within a respective pocket of the knitted component. For example, the pocket may be shaped with a tab-receiving portion that is specifically sized to receive the locating tab 194 such that the locating tab 194 slides into the tab-receiving portion upon insertion, thereby properly positioning and/or orienting the entirety of the cable guide 162.

Figure 8A:
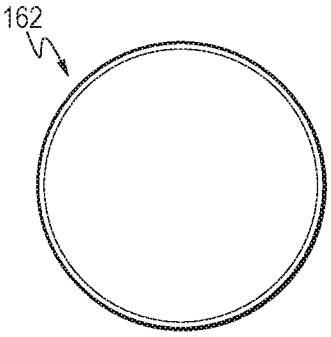
FIGS. 8A-B are illustrations showing various views of another embodiment of a cable guide for use in a knitted component in accordance with certain aspects of the present disclosure.
Figure 8B:
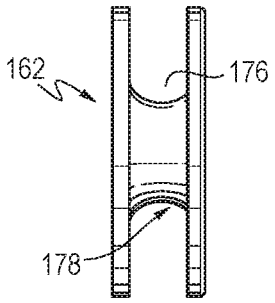
Figure 9A:
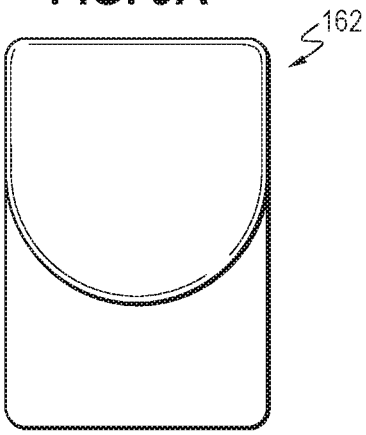
FIGS. 9A-B are illustrations showing various views of another embodiment of a cable guide for use in a knitted component in accordance with certain aspects of the present disclosure.
Figure 9B:
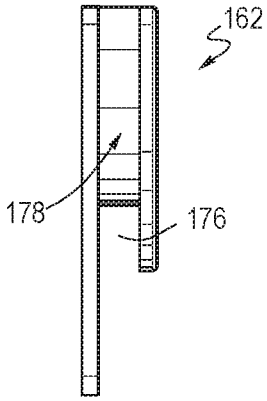

FIGS. 8A-B show another embodiment of a cable guide 162, which has a circular design. The curved surface 178 of the cable guide 162 extends around the entire circumference of the cable guide 162 in this embodiment. Such an embodiment may be advantageous since its orientation within a pocket does not affect its operation (e.g., it can rotate 360 degrees without substantially affecting contact between the cable and the curved surface 178), which may simplify its installation relative to other embodiments. Another embodiment, shown in FIGS. 9A-B, is similar to the embodiment of FIGS. 7A-C, but lacks the above-described deformable clip. Such an embodiment may be useful where the deformable clip is unnecessary.

Figure 10:
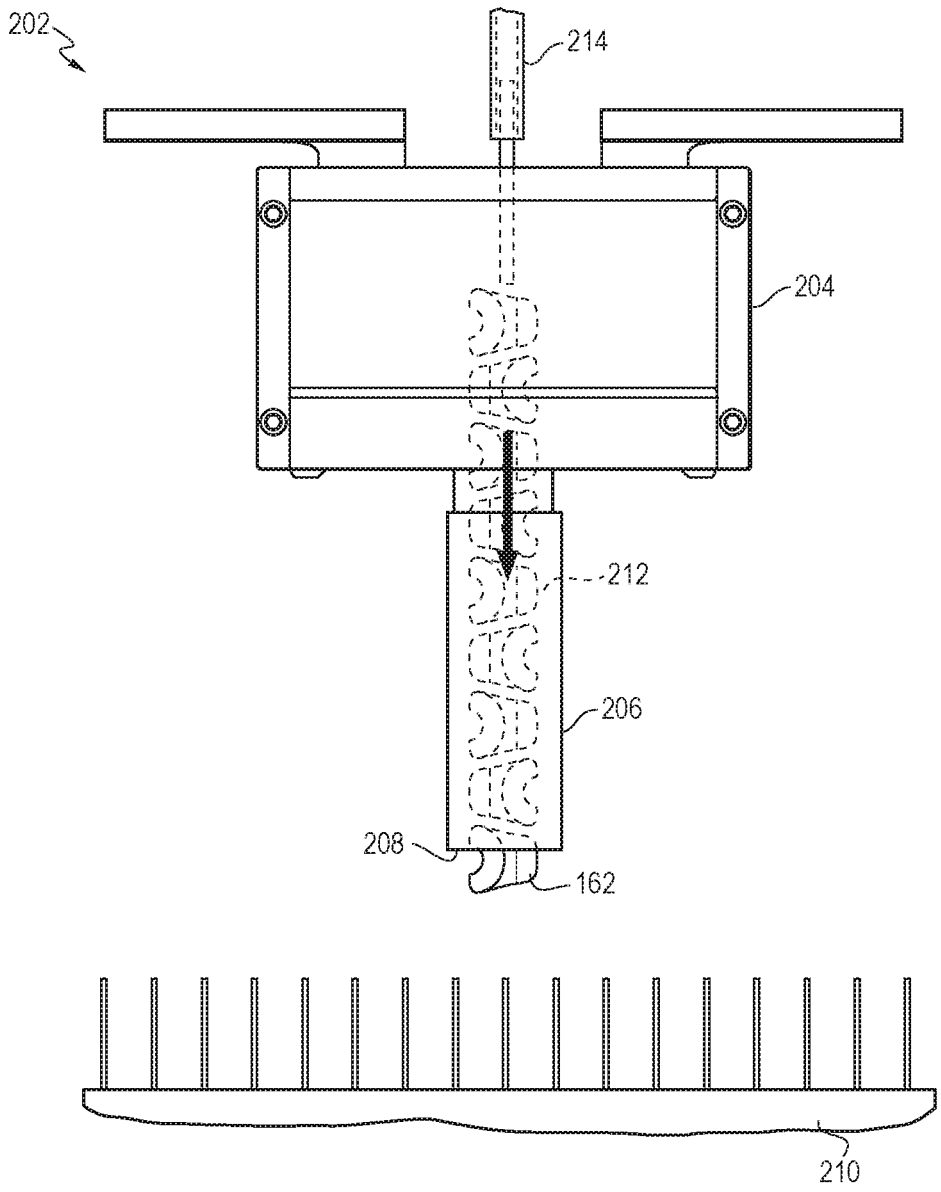
FIG. 10 is an illustration showing an insertion feeder for inserting at least one object into a knitted component in accordance with certain aspects of the present disclosure.

FIG. 10 shows an embodiment of an insertion feeder 202. The insertion feeder 202 may include a carrier 204 for securing the insertion feeder 202 to the knitting machine such that the carrier 204 is movable along a first axis relative to the knitting machine. A similar carrier 204 is depicted and described in U.S. Pat. No. 8,522,577, filed as U.S. patent application Ser. No. 13/048,527 on Mar. 15, 2011, which is hereby incorporated by reference in its entirety. A feeder arm 206 may be connected to the carrier 204. The feeder arm 206 may include a dispensing area 208 that cooperates with a needle bed 210. In some embodiments, the feeder arm 206 may be vertically movable such that the dispensing area 208 of the feeder arm 206 moves towards and/or away from the needle bed 210, which may be advantageous where the dispensing area 208 operates best when in close proximity to the needle bed 210 during an object insertion procedure.

As shown, the feeder arm 206 may include an interior cavity or chamber 212 that extends to the dispensing area 208. The chamber 212 may be configured (e.g., sized and shaped) to provide a magazine for holding a supply of objects that may be dispensed from the dispensing area 208 and thereby inserted into a knitted component during the knitting process (e.g., placed between two partially-knit layers as discussed above). In the depicted embodiment, the objects for insertion are cable guides 162. For example, the dispensing area 208 may be configured to selectively dispense one cable guide 162 at a time (e.g., when the insertion feeder 202 is moved into an appropriate position relative to the needle bed 210 via the carrier 204). An actuator 214, which may be located at any suitable location, may selectively actuate (e.g., provide a dispensing force) such that a single cable guide 162 is dispensed at the appropriate time.

The actuator 214 may include any suitable structure. As shown, the actuator 214 may include a linear actuator that provides a downward force on the cable guides 162. The chamber 212 may be relatively tight around the cable guides 162 such that they are retained within the chamber unless/until the actuator 214 forces them to displace. Alternatively (or additionally), the actuator 214 may include a door or gate located at the dispensing area 208 that selectively opens to allow objects to pass through when desired. Other suitable actuators are also contemplated.

When the cable guides 162 must be oriented in a particular direction, the cable guides 162 may be pre-loaded into the insertion feeder 202 such that they are oriented in a particular manner matching the requirement called for by the design of the knitted component. For example, in the embodiment of FIG. 1, the knitted component 122 may be knitted in a heel-to-toe manner (e.g., the heel area 118 is knitted first, and then the knitted component is formed in the vertical direction until its completion upon finalizing the toe area 120). When this pattern is utilized, a first cable guide 162*a* will be inserted first followed by a second cable guide 162*b*, followed by a third cable guide 162*c*, etc., thereby providing a serpentine path that corresponds with the serpentine orientation of the cable 160. In this embodiment, the direction that the cable guides 162 face alternates. That is, the curved surface of the first cable guide 162*a* faces the lateral direction, the curved surface of the second cable guide 162*b* faces the medial direction, the curved surface of the third cable guide 162*c* faces the lateral direction, etc. Notably, the cable guides 162 must be placed within the remainder of the knitted component in order (first, second, third . . . ) to match the sequence of formation of their corresponding locations by knitting loops on a knitting machine's needle beds. As such, referring back to FIG. 10, if a single insertion feeder 202 is used to insert all of the cable guides 162, the cable guides 162 may be pre-loaded in the chamber 212 in alternating orientations.

To form the knitted component 122 shown in FIG. 1 (and also referring to FIG. 10), one or more knitting feeders (not shown) may first knit the heel area 118. Once they reach the throat area 114, particularly a portion where a tube will be formed to receive the cable 160, the cable 160 may be inlaid (with an inlay feeder, not shown) within the tube (as discussed above). Then, the cable guide 162*a* may be placed in a pocket (as described in more detail above) with the insertion feeder 202 while the cable 160 is held in position (e.g., at the cable guide 162*a*). The inlay feeder and/or the insertion feeder 202 may be manipulated such that the cable 160 is inserted into the groove of the cable guide 162*a*, for example. Alternatively, the cable 160 may be placed into the groove of the cable guide 162*a* prior to inserting the cable guide 162*a* into the knitted component 122. After knitting a plurality of courses (e.g., to continue to form the area 119 of the throat area 114, the inlay feeder may return towards the medial side 112 of the knitted component 122, thereby inlaying the cable 160 as the serpentine orientation of the cable 160 continues. This process can be repeated, as necessary, until the knitted component 122 is fully formed.

Figure 11:
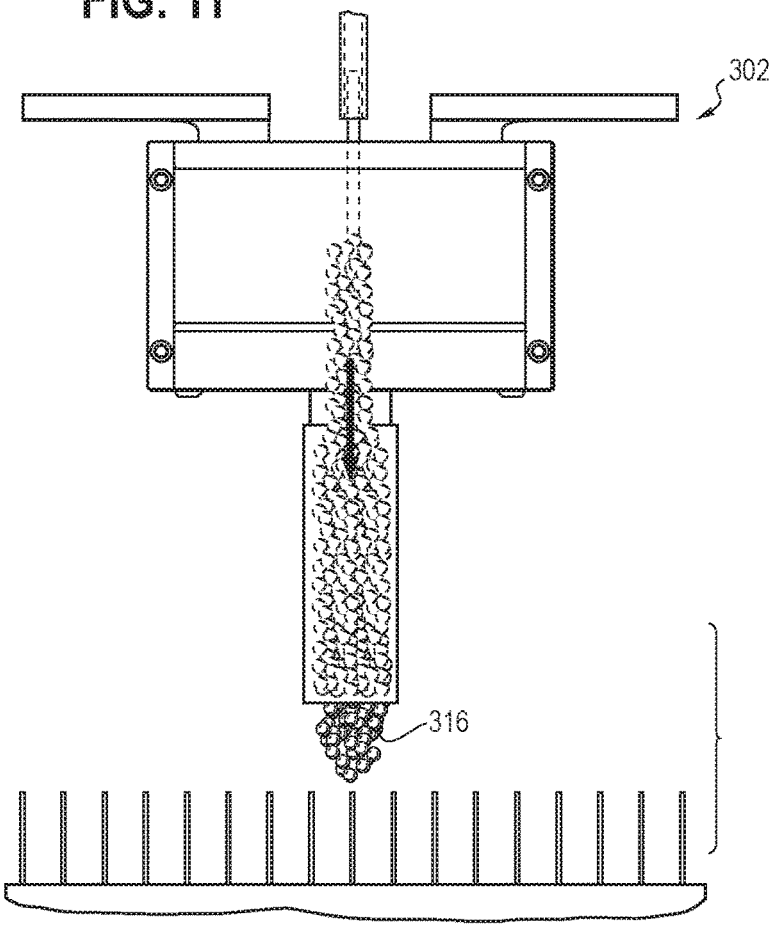
FIG. 11 is an illustration showing another embodiment of an insertion feeder for inserting at least one object into a knitted component in accordance with certain aspects of the present disclosure.
Figure 12:
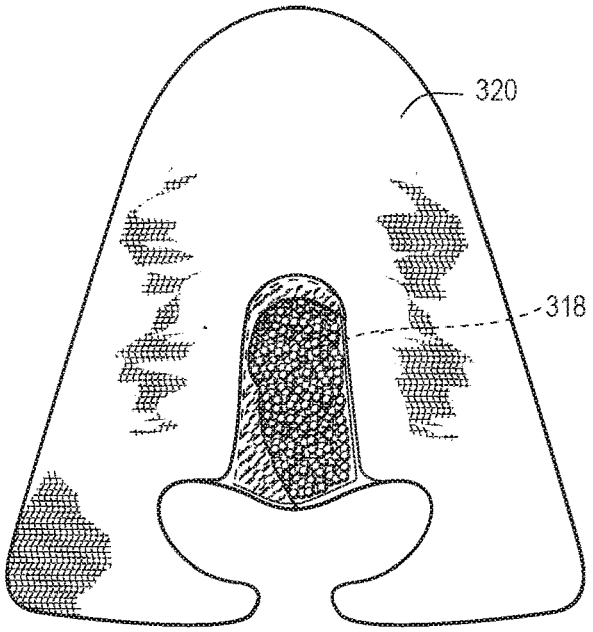
FIG. 12 is an illustration showing an embodiment of a knitted component having inserted beads in accordance with certain aspects of the present disclosure.

FIG. 11 shows another embodiment of an insertion feeder 302 configured to insert an object other than a cable guide as described above (although it is contemplated that a single insertion feeder can be configured to insert multiple objects, either with or without adjustment/retrofit). For example, the insertion feeder 302 of FIG. 11 may include a chamber that holds a plurality of beads 316, which may be inserted into a tube/pocket, such as the pocket 318 of a knitted component 320 (as shown in FIG. 12). The beads 316 may be foaming beads, for example, which expand when exposed to heat and/or another stimulus, thereby filling the pocket 318 of a knitted component 320 (FIG. 12) to provide cushioning. Other objects may additionally or alternatively be inserted, including (but not limited to) airbags (i.e., fluid (gas)-filled cushioning objects), other cushions, electronic components (e.g., sensors or RFID chips), actuators (e.g., for manipulating/tensioning a cable as discussed above), and/or any other suitable object. Further, it is contemplated that the insertion feeder 302 may insert a fluid (e.g., a gas or liquid, such as a foaming fluid), particularly when the surrounding knit is capable of retaining the fluid between its respective layers. Additionally or alternatively, the insertion feeder 302 may provide a heated gas to stimulate a material included in the knit (and/or an inserted element).

One general aspect, which may include any of the features described above (or a combination thereof), includes an article of footwear. The article of footwear may include a knitted component at least partially forming an upper for the article of footwear, where the knitted component includes a first knit layer and a second knit layer, the first knit layer being separable from the second knit layer such that a pocket is located between the first knit layer and the second knit layer; a cable located at least partially within the pocket; and a cable guide located at least partially within the pocket, where the cable guide includes at least one curved surface for contacting the cable, and where the cable extends around the at least one curved surface such that the cable changes directions within the pocket.

Certain embodiments of this aspect may include one or more of the following features described in this paragraph. The first knit layer may be secured to the second knit layer via a knit course extending along an edge of the pocket. The cable guide may include a groove including the at least one curved surface for contacting the cable. The cable guide may include a deformable clip configured to retain the cable within the groove. At least one of the first knit layer, the second knit layer, and the cable guide may include a thermoplastic material, where the thermoplastic material is at least partially fused to secure the cable guide to at least one of the first knit layer and the second knit layer. A second cable guide and a third cable guide may be included, where the cable extends in a serpentine pattern from the cable guide, to the second cable guide, and to the third cable guide, and where the serpentine pattern of the cable is retained between the first knit layer and the second knit layer of the knitted component. The cable guide and the third cable guide may be located on a first side of a throat area of the article of footwear, and the second cable guide may be located on a second side of the throat area such that the serpentine pattern of the cable crosses the throat area. An actuator may be included, and may be mechanically coupled to the cable, where the actuator is configured to move the cable relative to the cable guide during an actuation state. An exposed portion of the cable may be included, where the cable is movable relative to the at least one curved surface of the cable guide via manipulation of the exposed portion.

Another general aspect, which may include any of the features described above, includes a knitted component. The knitted component may include a first knit layer and a second knit layer, the first knit layer being separable from the second knit layer such that a pocket is located between the first knit layer and the second knit layer; a cable located at least partially within the pocket; and a cable guide located at least partially within the pocket, where the cable guide includes at least one curved surface for contacting the cable, and where the cable extends around the at least one curved surface such that the cable changes directions within the pocket.

Certain embodiments of this aspect may include one or more of the following features described in this paragraph. The first knit layer may be secured to the second knit layer via a knit course extending along an edge of the pocket. The cable guide may include a groove including the at least one curved surface for contacting the cable. The cable guide may include a deformable clip configured to retain the cable within the groove. At least one of the first knit layer, the second knit layer, and the cable guide may include a thermoplastic material, where the thermoplastic material is at least partially fused to secure the cable guide to at least one of the first knit layer and the second knit layer. A second cable guide and a third cable guide may be included, where the cable extends in a serpentine pattern from the cable guide, to the second cable guide, and to the third cable guide, and where the serpentine pattern of the cable is retained between the first knit layer and the second knit layer of the knitted component.

Another general aspect, which may include any of the features described above, includes a method for knitting a knitted component. The method may include one or more of the following steps: knitting a first portion of a knitted component, where the first portion includes a double-jersey knit structure formed with a first needle bed and a second needle bed of a knitting machine; knitting a second portion of the knitted component after knitting the first portion, where the second portion includes a first knit layer and a second knit layer, the first knit layer being separable from the second knit layer such that a pocket is located between the first knit layer and the second knit layer; inserting a cable and a cable guide between the first knit layer and the second knit layer, where the cable extends at least partially around the cable guide; and knitting a third portion of the knitted component after knitting the second portion, where the third portion of the knitted component includes a double-jersey knit structure.

Certain embodiments of this aspect may include one or more of the following features described in this paragraph. The cable guide may be inserted using an insertion feeder, the insertion feeder being movable along a longitudinal direction relative to the first needle bed and the second needle bed of the knitting machine. A first course may connect the first portion of the knitted component to the second portion of the knitted component, where a second course connects the second portion of the knitted component to the third portion of the knitted component. The first course and the second course may form edges of the pocket between the first knit layer and the second knit layer. The method further include manipulating the knitted component such that it forms an upper for an article of footwear.

Another general aspect, which may include any of the features described above, includes an insertion feeder for a knitting machine. The insertion feeder may include a carrier for securing the insertion feeder to the knitting machine such that the carrier is movable along a first axis relative to the knitting machine; and a feeder arm extending outward from the carrier, where the feeder arm includes a dispensing area at an end opposite the carrier, where the feeder arm includes a chamber extending to the dispensing area, and where the dispensing area includes an actuator for selectively dispensing at least one object located within the chamber.

Certain embodiments of this aspect may include one or more of the following features described in this paragraph. The actuator may include a linear actuator. The actuator may include a gate located at the dispensing area. The chamber may form a magazine for holding a plurality of cable guides. The feeder arm may be movable vertically such that the dispensing area is movable to a location adjacent to a needle bed of the knitting machine.

While various embodiments of the present disclosure have been described, the present disclosure is not to be restricted except in light of the attached claims and their equivalents. One skilled in the relevant art will recognize that numerous variations and modifications may be made to the embodiments described above without departing from the scope of the present invention, as defined by the appended claims. Moreover, the advantages described herein are not necessarily the only advantages of the present disclosure and it is not necessarily expected that every embodiment of the present disclosure will achieve all of the advantages described.

We claim:

1. An article of footwear, comprising:

a knitted component at least partially forming an upper for the article of footwear, wherein the knitted component comprises a first knit layer and a second knit layer, the first knit layer being separable from the second knit layer such that a pocket is located between the first knit layer and the second knit layer, wherein the pocket comprises a tubular structure forming a channel and is defined by the first knit layer and the second knit layer;

a cable located at least partially within the pocket; and a cable guide located at least partially within the pocket, wherein the cable guide includes at least one curved surface for contacting the cable, wherein a first portion of the cable extends around the at least one curved surface such that the cable changes direction within the pocket, wherein a second portion of the cable is external to the cable guide and is located at least partially within the channel of the tubular structure of the pocket.

2. The article of footwear of claim 1, wherein the first knit layer is secured to the second knit layer via a knit course extending along an edge of the pocket.

3. The article of footwear of claim 1, wherein the cable guide includes a groove comprising the at least one curved surface for contacting the cable.

4. The article of footwear of claim 3, wherein the cable guide includes a deformable clip configured to retain the cable within the groove.

5. The article of footwear of claim 1, wherein at least one of the first knit layer, the second knit layer, and the cable guide comprises a thermoplastic material, and wherein the thermoplastic material is at least partially fused to secure the cable guide to at least one of the first knit layer and the second knit layer.

6. The article of footwear of claim 1, further comprising a second cable guide and a third cable guide, wherein the cable extends in a serpentine pattern from the cable guide, to the second cable guide, and to the third cable guide, and wherein the serpentine pattern of the cable is retained between the first knit layer and the second knit layer of the knitted component.

7. The article of footwear of claim 6, wherein the cable guide and the third cable guide are located on a first side of a throat area of the article of footwear, and wherein the second cable guide is located on a second side of the throat area such that the serpentine pattern of the cable crosses the throat area.

8. The article of footwear of claim 1, further comprising an actuator that is mechanically coupled to an exposed portion of the cable, wherein the actuator is configured to move the cable relative to the cable guide during an actuation state.

9. The article of footwear of claim 1, wherein an exposed portion of the cable is exposed at an opening of the pocket located at a perimeter edge of the knitted component.

10. An article of footwear, comprising:

a knitted component at least partially forming an upper for the article of footwear, wherein the knitted component comprises a first knit layer and a second knit layer, the first knit layer being separable from the second knit layer such that a pocket is located between the first knit layer and the second knit layer, wherein the pocket comprises a tubular structure forming a channel and is defined by the first knit layer and the second knit layer;

a sole structure secured to the knitted component, a cable located at least partially within the pocket; and a cable guide located at least partially within the pocket, wherein a first portion of the cable extends around the cable guide within the pocket, and wherein a second portion of the cable is external to the cable guide and is located at least partially within the channel of the tubular structure.

11. The article of footwear of claim 10, wherein the first knit layer is secured to the second knit layer via a knit course extending along an edge of the pocket.

12. The article of footwear of claim 10, wherein the cable guide includes a groove comprising the at least one curved surface for contacting the cable.

13. The article of footwear of claim 12, wherein the cable guide includes a deformable clip configured to retain the cable within the groove.

14. The article of footwear of claim 10, wherein at least one of the first knit layer, the second knit layer, and the cable guide comprises a thermoplastic material, and wherein the thermoplastic material is at least partially fused to secure the cable guide to at least one of the first knit layer and the second knit layer.

15. An article of footwear, comprising:

a knitted component at least partially forming an upper for the article of footwear, wherein the knitted component comprises a first knit layer and a second knit layer, the first knit layer being separable from the second knit layer such that a continuous pocket comprising multiple portions is located between the first knit layer and the second knit layer;

a cable located at least partially within the continuous pocket; and a first cable guide located at least partially within a first portion of the continuous pocket and a second cable guide located at least partially within a second portion of the continuous pocket, wherein a third portion of the continuous pocket comprises a tube connecting the first portion of the continuous pocket and the second portion of the continuous pocket, wherein the cable extends within the continuous pocket around the first cable guide, through the tube of the third portion, and to the second cable guide.

16. The article of footwear of claim 15, further comprising a third cable guide located in a fourth portion of the continuous pocket, wherein the cable extends, within the continuous pocket, in a serpentine pattern from the first cable guide, to the second cable guide, and to the third cable guide, and wherein the first cable guide, the second cable guide, and the third cable guide are located on one of a medial side or a lateral side of the upper.

17. The article of footwear of claim 15, wherein the tube is formed by the first knit layer and the second knit layer.

18. The article of footwear of claim 17, wherein the first knit layer overlaps and is at least partially coextensive with the second knit layer.

19. The article of footwear of claim 1, wherein the cable includes an exposed portion.

20. The article of footwear of claim 19, wherein the cable is movable relative to the at least one curved surface of the cable guide via manipulation of the exposed portion.

* * * * *